US010954637B2

(12) United States Patent
Kaiser

(10) Patent No.: US 10,954,637 B2
(45) Date of Patent: Mar. 23, 2021

(54) MEASUREMENT DEVICE AND METHOD FOR DETECTING A TRACK GEOMETRY

(71) Applicant: Plasser & Theurer Export von Bahnbaumaschinen GmbH, Vienna (AT)

(72) Inventor: Christoph Kaiser, St. Stefan am Walde (AT)

(73) Assignee: Plasser & Theurer Export von Bahnbaumaschinen GmbH, Vienna (AT)

( * ) Notice: Subject to any disclaimer, the term of this patent is extended or adjusted under 35 U.S.C. 154(b) by 130 days.

(21) Appl. No.: 16/348,725

(22) PCT Filed: Nov. 29, 2017

(86) PCT No.: PCT/EP2017/080757
§ 371 (c)(1),
(2) Date: May 9, 2019

(87) PCT Pub. No.: WO2018/114252
PCT Pub. Date: Jun. 28, 2018

(65) Prior Publication Data

US 2019/0284767 A1 Sep. 19, 2019

(30) Foreign Application Priority Data

Dec. 19, 2016 (AT) ..... A 574/2016

(51) Int. Cl.

| | |
|---|---|
| ***E01B 35/04*** | (2006.01) |
| ***E01B 27/17*** | (2006.01) |
| ***E01B 35/00*** | (2006.01) |
| ***E01B 35/06*** | (2006.01) |

(52) U.S. Cl.
CPC ..... *E01B 35/04* (2013.01); *E01B 27/17* (2013.01); *E01B 35/00* (2013.01); *E01B 35/06* (2013.01); *E01B 2203/16* (2013.01)

(58) Field of Classification Search
None
See application file for complete search history.

(56) References Cited

U.S. PATENT DOCUMENTS 3,968,752 A * 7/1976 Theurer ..... E01B 27/17 104/7.2
4,179,696 A 12/1979 Quesinberry et al.
(Continued)

FOREIGN PATENT DOCUMENTS

CN 1263019 A 8/2000
CN 102358325 A 2/2012
(Continued)

OTHER PUBLICATIONS

Chinese Office Action in Chinese Application No. 201780078798.3, dated Oct. 16, 2020.
(Continued)

*Primary Examiner* — Peter J Macchiarolo
*Assistant Examiner* — Jermaine L Jenkins
(74) *Attorney, Agent, or Firm* — Collard & Roe, P.C.

(57) ABSTRACT

The invention relates to a measuring device (13) for recording a track geometry of a track (5) immediately after a treatment of the track (5) by means of track maintenance machine (1), wherein the measuring device comprises wheel axles (16) for travelling on the track (5), connecting elements (15) for mounting to the track maintenance machine (1) and a data interface (41) for exchanging data with the track maintenance machine (1). Further, the measuring device (13) comprises an assembly frame (22) on which an inertial measuring unit (14) is arranged, wherein a front wheel axle (16) and a rear wheel axle (16) are mounted on the assembly frame (22) for rotation relative to one another about an axis of rotation (21) extending orthogonally to the wheel axles (16). Thus, an efficient check measurement of the lateral, longitudinal and vertical position of the track (5) is possible.

15 Claims, 3 Drawing Sheets

(56) References Cited

U.S. PATENT DOCUMENTS

| | | | | |
|---|---|---|---|---|
| 4,881,467 | A | 11/1989 | Theurer | |
| 6,014,815 | A | 1/2000 | Jäger | |
| 6,154,973 | A | 12/2000 | Theurer et al. | |
| 8,914,162 | B2 * | 12/2014 | Kernwein | B61K 9/08 701/1 |
| 2003/0097235 | A1 | 5/2003 | Theurer et al. | |
| 2007/0213926 | A1 | 9/2007 | Jager | |
| 2010/0025715 | A1 | 2/2010 | Neidrich | |
| 2010/0154233 | A1 | 6/2010 | Theurer et al. | |
| 2014/0142868 | A1 * | 5/2014 | Bidaud | B61D 15/12 702/40 |
| 2018/0222504 | A1 * | 8/2018 | Birch | B61L 23/048 |

FOREIGN PATENT DOCUMENTS

| | | | |
|---|---|---|---|
| CN | 202298394 | U | 7/2012 |
| CN | 104775342 | A | 7/2015 |
| EP | 0 806 523 | A1 | 11/1997 |
| EP | 0952254 | A1 | 10/1999 |
| EP | 2176465 | B1 | 1/2011 |
| JP | S5356056 | A | 5/1978 |
| JP | S64-71903 | A | 3/1989 |
| WO | 2005/103385 | A1 | 11/2005 |
| WO | 2013152827 | A2 | 10/2013 |

OTHER PUBLICATIONS

International Search Report of PCT/EP2017/080727, dated May 4, 2018.

Xuemei Wang and Wenbo Ni, "Strapdown Inertial Measurement Method Based on Data Fusion Technique and Its Application to Railway Track," Journal of Southwest Jiaotong University, vol. 49, Issue 1, published on Dec. 10, 2013, 18 pages.

English translation of the Chinese Office Action issued for Chinese Application No. 201780078798.3, dated Oct. 16, 2020, 8 pages.

* cited by examiner

MEASUREMENT DEVICE AND METHOD FOR DETECTING A TRACK GEOMETRY

CROSS REFERENCE TO RELATED APPLICATIONS

This application is the National Stage of PCT/EP2017/080757 filed on Nov. 29, 2017, which claims priority under 35 U.S.C. § 119 of Austrian Application No. A 574/2016 filed on Dec. 19, 2016, the disclosures of which are incorporated by reference. The international application under PCT article 21(2) was not published in English.

FIELD OF TECHNOLOGY

The invention relates to a measuring device for recording a track geometry of a track immediately after a treatment of the track by means of track maintenance machine, wherein the measuring device comprises wheel axles for travelling on the track, connecting elements for mounting to the track maintenance machine and a data interface for exchanging data with the track maintenance machine. The invention additionally relates to a method for recording a track geometry by means of the measuring device.

PRIOR ART

During track maintenance operations, an acceptance measurement is often required in order to verify compliance with standards and other specifications. To that end, in short construction sections, hand measuring instruments are often employed. In the case of extensive construction- or maintenance activities, a measuring vehicle is used after finishing the operations in order to record the track geometry of the treated track section. It is also known to traverse a track section, having been treated by means of a track maintenance machine, a second time after termination of the track maintenance work for a check measurement.

Also known are measuring devices which can be attached to a track maintenance machine and enable a check measurement of the track immediately following a treatment carried out with the track maintenance machine. For example, EP 0 952 254 A1 discloses a track tamping machine with a trailer on which such a measuring device is mounted. This measuring device comprises three measuring trolleys. A measuring chord is stretched between the outer measuring trolleys, wherein the distance of the chord to measuring devices on the central measuring trolley is registered. Thus, the track geometry can be check-measured by means of the moving-chord measuring principle (three-point measurement). Additionally, it is possible by means of inclination sensors (pendulums) attached to the measuring trolleys to measure a track super-elevation.

SUMMARY OF THE INVENTION

It is the object of the invention to improve a measuring device of the type mentioned at the beginning with respect to the prior art. Further, a method carried out by means of the measuring device is to be shown.

According to the invention, these objects are achieved by way of the features of claims 1 and 13. Advantageous further embodiments of the invention become apparent from the dependent claims.

In this, the measuring device comprises an assembly frame on which an inertial measuring unit is arranged, wherein a front wheel axle and a rear wheel axle are mounted on the assembly frame for rotation relative to one another about an axis of rotation extending orthogonally to the wheel axles. Such a compact measuring device can be fastened in a simple manner to an existing track maintenance machine in order to carry out an efficient check-measurement of the lateral, longitudinal and vertical position of the track immediately following a track treatment. There is no need for a trailer. The rotatability of the axles relative to one another ensures that the assembly frame with the inertial measuring device follows the track course precisely.

During this it is favourable if, to form the axis of rotation, the assembly frame is divided by a rotation joint into a front frame part and a rear frame part. Such a design is robust against shocks and, by way of a play-free embodiment of the rotation joint, ensures a very precise check-measurement.

A further improvement provides that the connecting elements comprise a first Watt linkage for guiding the assembly frame in lateral direction. If the measuring device is fastened to a track maintenance machine, the position of the measuring device relative to the track maintenance machine remains constant in the longitudinal direction, and a simple allocation of the measurement results in the longitudinal direction of the track can take place.

In order to enable the measuring device to be used as a rear measuring trolley of a levelling measuring system of a track maintenance machine, the measuring device advantageously comprises a support bracket for each rail for coupling to a linkage of a levelling chord.

For use as a rear measuring trolley of a lining measuring system of a track maintenance machine, it is useful if the measuring device comprises a chord tensioning device for clamping a lining chord. In this, the measuring device has a dual function. On the one hand, the check measurement is carried out and, on the other hand, the measuring device serves as a measuring system component for controlling a track treatment.

Favourably in this, the chord tensioning device is connected via a steering arm, supported centrally on the assembly frame, to a second Watt linkage for connection to the track maintenance machine. By way of this kinematic design of the connecting elements it is ensured that there is no torque acting on the measuring device as a result of a pulling force exerted asymmetrically by means of the lining chord on the measuring device. Such a torque could compromise the measurement precision.

In one design of the invention it is provided that at least one contact-less position measuring device is arranged for determining the position of the assembly frame relative to each rail. With this, a relationship of the spatial curve, recorded by means of the inertial measuring unit, with respect to the course of the rail is established, from which a separate spatial curve for each rail ensues.

In a robust alternative embodiment, each wheel axle is designed as a telescopic axle on which the measuring wheels having cylindrical running surfaces are arranged. With this, during a measuring operation, the position of the inertial measuring unit, fastened to the assembly frame, relative to a rail is determined in order to record the course of this rail as a spatial curve.

Advantageously, a measuring sensor for registering a track gauge is associated with at least one telescopic axle. With the registered course of the track gauge, it is possible to derive from the spatial curve recorded by means of the inertial measuring unit also the course of the other rail.

For travelling on switches and crossings without the danger of derailment, it is useful if a guide blade for guidance along a check rail is associated with each measuring wheel. The particular guide blade pulls the associated measuring wheel inward as soon as it is guided along a check rail. In this manner, it is avoided that a measuring wheel is pressed into a rail gap by a telescopic axle.

Usefully, at least one measuring wheel is designed as an element of a path measuring device in order to allocate the position changes recorded by the inertial measuring unit to the path travelled on the track.

For low-wear and precise measurement, it is advantageous if each measuring wheel comprises a running wheel and a flange which are mounted on a shaft for rotation relative to one another. During curve travel, the line of contact between running wheel and rail and the line of contact between flange and rail have different arc lengths. By separating the measuring wheel into running wheel and flange, there is no friction.

The method, according to the invention, for recording a track geometry by means of the measuring device provides that, immediately after an rail undercarriage of the track tamping machine has travelled on the track, the wheel axles of the measuring device are pressed onto the rail from above for check measurement of the track geometry, and that the position of the assembly frame is registered by the inertial measuring unit. In this way, the track geometry is recorded after a treatment of the track, wherein the rail undercarriage of the track tamping machine causes a stabilization of the track immediately prior to the measurement.

In an advantageous further development of the method, a separate spatial curve is established in an evaluation device from a spatial curve recorded by means of the inertial measuring unit and from a recorded track gauge.

When the measuring device is used as a measuring trolley of a lining measuring system, it is useful if a chord tensioning device, arranged on the measuring device and laterally guided between two stops, is pressed against one of the two stops for positioning relative to a rail. In this manner, the lining measuring system can be applied selectively to one of the rails of the track.

BRIEF DESCRIPTION OF THE DRAWINGS

The invention will be described by way of example below with reference to the attached figures. There is shown in schematic representation in.

DESCRIPTION OF THE EMBODIMENTS

Figure 1:
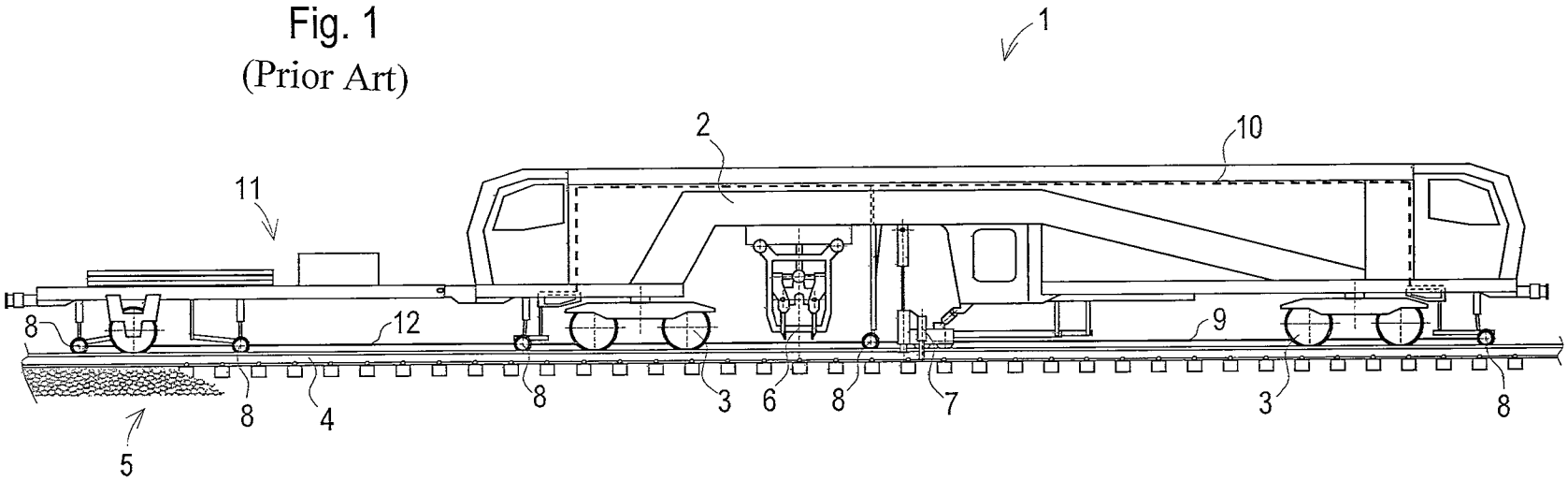
Fig. 1 (Prior Art)
FIG. 1 a track tamping machine with a measuring device according to the prior art FIG. 2 a measuring device fastened to a track tamping machine FIG. 3 a side view of a measuring device FIG. 4 a top view of a measuring device FIG. 5 a measuring device having a chord tensioning device
Figure 2:
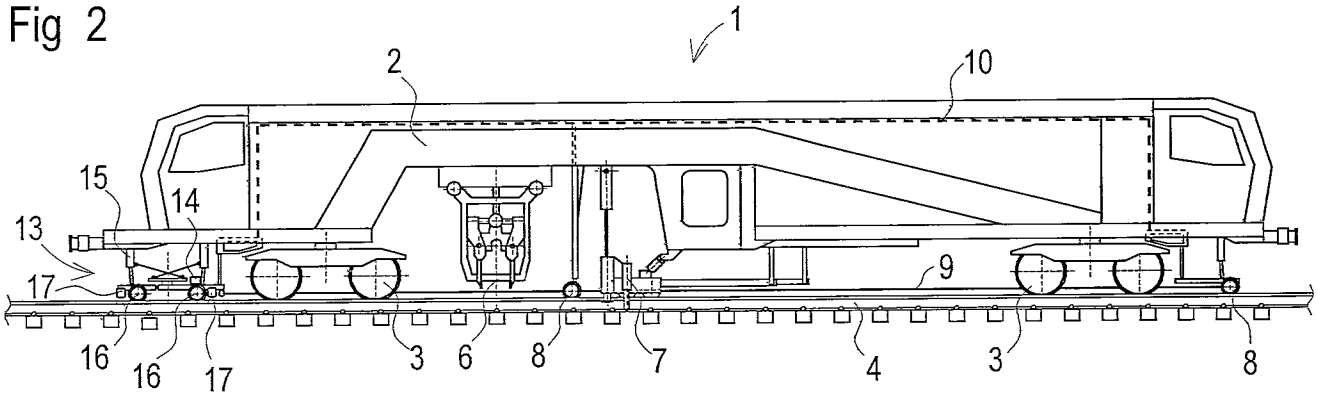

As an example of a track maintenance machine 1, a track tamping machine is shown in FIGS. 1 and 2. The latter comprises a machine frame 2 which is mobile on rails 4 of a track 5 by means of rail undercarriages 3. A tamping unit 6 and a lifting/lining unit 7 are arranged as working units. In a known manner, a lining measuring system and a levelling measuring system comprise three measuring trolleys 8, a lining chord 9 and two levelling chords 10. Using these measuring systems, the lifting-lining unit 7 is controlled during lining and levelling of the track 5.

After tamping, the track position achieved is checked. For this check measurement, the track maintenance machine 1 in FIG. 1 comprises, according to the prior art, a trailer 11 with two further measuring trolleys 8. In this, an additional measuring chord 12 is stretched for a three-point measurement according to the moving chord measuring principle.

According to the invention, the check measurement is improved if, instead of a trailer 11 equipped with additional measuring trolleys 8, a measuring device 13 with an inertial measuring unit 14 is employed (FIG. 2). This measuring device 13 can be fastened to the track maintenance machine 1 by means of several connecting elements 15 and is mobile on the track 5 by means of wheel axles 16. Optionally, the measuring device 13 serves additionally as a measuring trolley of the lining measuring system and the levelling measuring system.

In one embodiment of the invention, the measuring device 13 comprises contact-less position measuring devices 17 (for example, laser line scanners). In this, two position measuring devices 17 spaced from one another are directed at each rail 4 in order to determine exactly the position of the inertial measuring unit 14 relative to the rails 4. In this manner, the courses of the two rails 4 can be derived from a spatial curve recorded by means of the inertial measuring unit 14.

Figure 3:
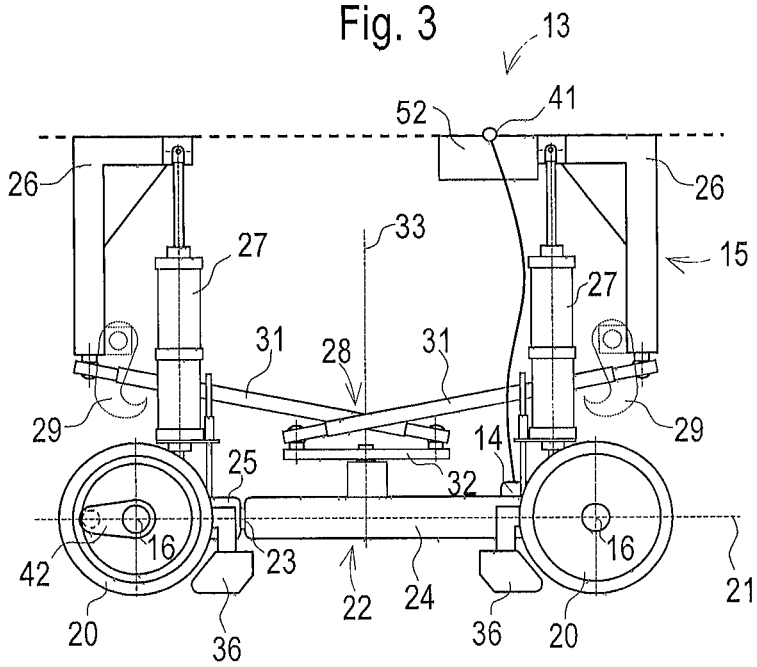
Figure 4:
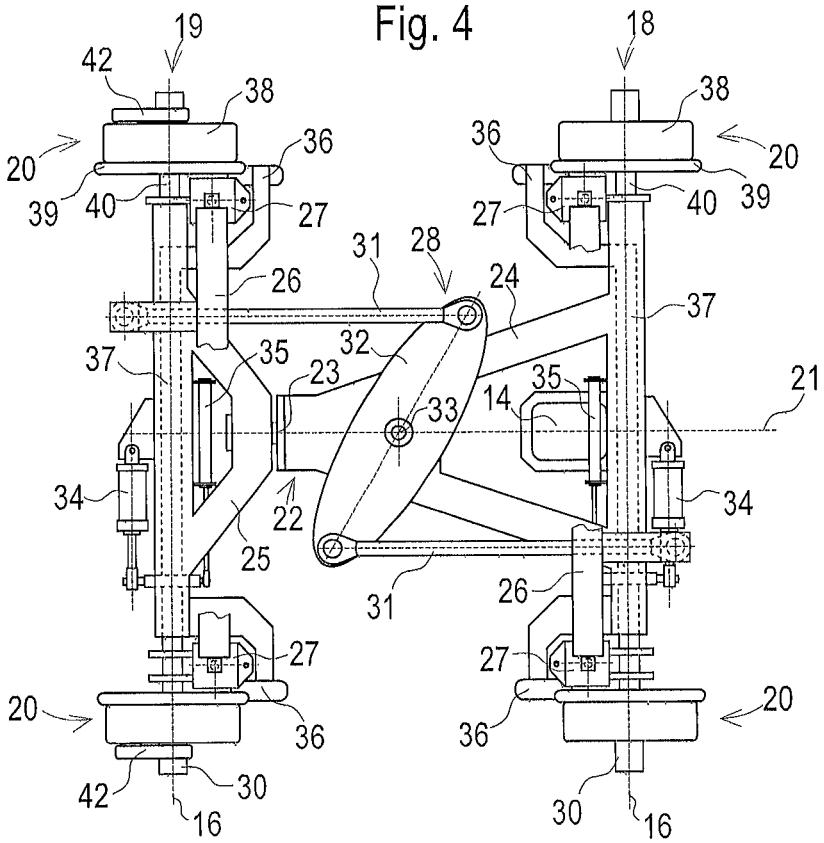
Figure 5:
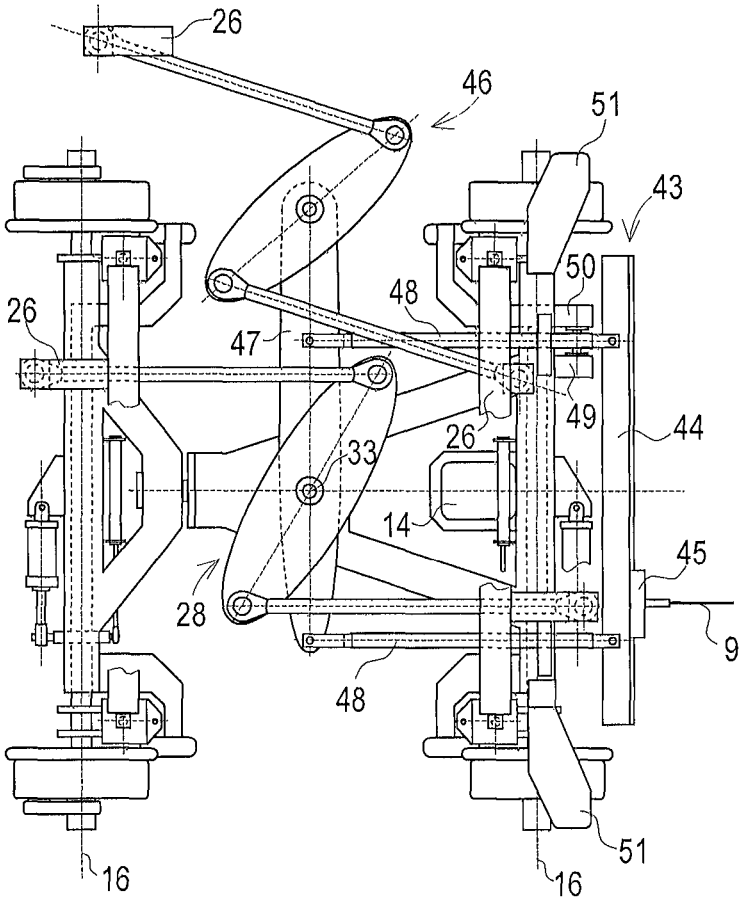

Shown in FIGS. 3 to 5 is an embodiment of the measuring device 13 having wheel axles 16 designed as telescopic axles 18, 19. Arranged at a front telescopic axle 18 and a rear telescopic axle 19 are measuring wheels 20 having cylindrical running surfaces. The telescopic axles 18, 19 are mounted for rotation relative to one another about an axis of rotation 21 extending orthogonally. To that end, an assembly frame 22 is split by means of a play-free rotation joint 23 into a front frame part 24 and a rear frame part 25. For example, several tapered roller bearings tensioned against each other are arranged in the rotation joint 23.

Arranged centrally at the front frame part 24 is the inertial measuring unit 14. The latter thus detects each position change of the front frame part 24 when the same is moved along the track 5. The measurement result is a spatial curve which corresponds exactly to the course of each rail 4 against which the assembly frame 22 with the measuring wheels 20 is applied laterally.

Arranged as examples of connecting elements 15 are two connecting brackets 26, four pneumatic vertical cylinders 27 and a first Watt linkage 28. By means of the vertical cylinders 27, the measuring device 13 can be lowered from a transport position into a working position, wherein a length measuring sensor may be associated with each vertical cylinder 27. With this it is possible to determine the position of the measuring device 13 relative to track maintenance machine 1. In this manner, the measuring device 13 can be on- or off-tracked by remote control and, during a measuring operation, can be pressed from above onto the rails 4 with a constant pressure.

In this, it is favourable if remote-controlled locking elements 29 are provided for fixation in the transport position. These are, for example, hooks which are pivotable by means of separate drives and can be hooked at shaft ends 30 of the telescopic axles 18, 19.

The first Watt linkage 28 (lemniscate steering arm with a horizontal movement plane) effects a lateral guiding of the measuring device 13 relative to the track maintenance machine 1. It comprises two lever rods 31 of equal length which can be articulatedly fastened at one end in each case to the track maintenance machine 1 or to the connecting brackets 26. The other ends are connected to one another via a coupling element 32. In this, the coupling element 32 is mounted in the center of the measuring device 13 for rotation symmetrically about a guiding rotation axis 33.

In this manner, the guiding rotation axis 33 is guided during curve travel on an orthogonal to the longitudinal axis of the track maintenance machine. Thus, the position of the measuring device 13 in the longitudinal direction relative to the track maintenance machine 1 always remains unchanged, so that a simple allocation of the check measurement results in the longitudinal direction can take place.

A pneumatic horizontal cylinder 34 is associated with each telescopic axis 18, 19 in order to press the measuring wheels 20 against the respective inner side of the rails 4 during a measuring operation. With the pneumatic cylinders 34, it is possible to realize a steady pressing force. In addition, the measuring wheels 20 can be pulled inward prior to lifting the measuring device 13. In particular, one measuring wheel 20 on each telescopic axle 18, 19 is laterally displaceable relative to the assembly frame 22. The non-displaceable measuring wheel 20 in each case is guided with the assembly frame 22 along the associated rails 4, wherein the respective displaceable measuring wheel 20 compensates a changing gauge of the track 5.

For registering the track gauge, a measuring sensor 35 is associated with each telescopic axle 18, 19, which continuously measures the variable length of the particular telescopic axle 18, 19. From the spatial curve of a rail 4 recorded with the inertial measuring unit 14, a spatial curve of the second rail 4 is determined via the track gauge. In this way, an exact check measurement of both rails is enabled.

A guiding blade 36 is associated with each measuring wheel 20 to ensure safe travel through switches and crossings. In this, the guiding blade 36 associated with the particular measuring wheel 20 is situated at the other side of the measuring device 13 and pulls the measuring wheel 20 inward upon contact with a check rail. By way of a connection 37, shown in dashed lines, the displaceable measuring wheel 20 in each case is coupled with the associated guiding blade 36, so that the measuring wheel 20 and guiding blade 36 are displaceable together.

Additionally, each measuring wheel 20 is of split design. In this, a running wheel 38 and a flange 30 are mounted separately on a shaft 40. During travel in a curve, the running wheel 38 and the flange 39 can rotate with different speeds of rotation and thus can compensate different arc lengths of the lines of contact with the rail 4.

Beside a pneumatic connection, the measuring device 13 comprises a data interface 41 for data exchange with the track maintenance machine 1. For example, a bus system of the track maintenance machine 1 is used to transmit measurement data and control data. The unchangeable longitudinal positioning of the measuring device 13 relative to the track maintenance machine 1 facilitates the data comparison with other measuring devices of the track maintenance machine 1.

Preferably, one measuring wheel 20 for each rail 4 is designed as an element of a path measuring device 42. With this, an improved allocation of the measuring results to the kilometre marking of the track 5 is achieved. The respective path measuring device 42 is arranged with a torque support, for example, at an outer side of the associated measuring wheel 20.

In FIG. 5, a measuring device 13 is designed as a rear measuring trolley of a lining measuring system and of a levelling measuring system of a track maintenance machine 1. To that end, the measuring device 13 comprises a chord tensioning device 43 with a transverse beam 44 in which a carriage 45 is guided. A rear end of a lining chord 9 can be clamped in the carriage 45. When travelling in a curve, the carriage 45 is displaced laterally by means of a drive in order to enable a tracking of the chord.

In order to prevent an off-center pulling stress of the lining chord 9 from exerting a disruptive torque on the measuring device 13, a second Watt linkage 46 is arranged, by means of which a centrally mounted steering arm 47 can be coupled to the track maintenance machine 1. Thus, the position of the steering arm 47 during curve travel always remains aligned orthogonally to the longitudinal axis of the track machine.

The transverse beam 44 of the chord tensioning device 43 is connected to the steering arm 47 via two coupling rods 48. In this way, the torque caused by the off-centric lining chord tension is braced on the track maintenance machine 1 via the coupling rods 48, the steering arm 47, the second Watt linkage 46 and a connecting bracket 26. The counter force in the longitudinal direction, which occurs in the process at the central guiding rotation axis 33, is absorbed by the track maintenance machine 1 via the first Watt linkage 28, so that the measuring device 13 remains totally uninfluenced by the pulling force of the lining chord 9.

In order to be able to correlate the lining measuring system selectively to one of the two rails 4 of the track 5, the transverse beam 44 is guided laterally between two stops 49, 50, wherein only one stop 49 has a rigid connection to the assembly frame 22. In a first operating position, an actuator presses the transverse beam 44 against this stop 49, causing the lining measuring system and the assembly frame 22 to be applied to the same rail 4.

The second stop 50 is coupled to the transversely displaceable measuring wheel 20 and the guiding blade 26 belonging thereto. When the transverse beam 44 is pressed against this stop 50 in a second operating position, the other rail 4 serves as reference for the lining measuring system. In this manner, in a curve the inner rail can always be selected as reference base for the lining measuring system.

Additionally, two support brackets 51 are arranged on the assembly frame 22 on this measuring device 13 in order to be able to transmit a vertical position of the measuring device 13 via linkages to levelling chords 10 of the levelling measuring system.

In an optical track measuring system (such as according to Austrian patent application 325/2016, for example) there is no need for a chord tensioning device 43. Instead, a bracket for fastening a camera is arranged on the measuring device 13, for example.

An evaluation device 52 is arranged directly in the measuring device 13 or in the track maintenance machine 1 in order to evaluate the data of the inertial measuring unit 14, the position measuring devices 19 or the measuring sensors 35 for registering the track gauge, and to compile a spatial curve for each rail 4.

The invention claimed is:

1. A measuring device (13) for recording a track geometry of a track (5) immediately after a treatment of the track (5) by means of track maintenance machine (1), wherein the measuring device comprises wheel axles (16) for travelling on the track (5), connecting elements (15) for mounting to the track maintenance machine (1) and a data interface (41) for exchanging data with the track maintenance machine (1), wherein the measuring device (13) comprises an assembly frame (22) on which an inertial measuring unit (14) is arranged, and that a front wheel axle (16) and a rear wheel axle (16) are mounted on the assembly frame (22) for rotation relative to one another about an axis of rotation (21) extending orthogonally to the wheel axles (16).

2. The measuring device (13) according to claim 1, wherein to form the axis of rotation (21), the assembly frame (22) is split by a rotation joint (23) into a front frame part (24) and a rear frame part (25).

3. The measuring device (13) according to claim 1, wherein the connecting elements (15) comprise a first Watt linkage (28) for guiding the assembly frame (22) in lateral direction.

4. The measuring device (13) according to claim 1, wherein the measuring device (13) comprises a support bracket (51) for each rail (4) for coupling to a linkage of a levelling chord (10).

5. The measuring device (13) according to claim 1, wherein the measuring device (13) comprises a chord tensioning device (43) for clamping a lining chord (9).

6. The measuring device (13) according to claim 5, wherein the chord tensioning device (43) is connected via a steering arm (47), supported centrally on the assembly frame (22), to a second Watt linkage (46) for connection to the track maintenance machine (1).

7. The measuring device (13) according to claim 1, wherein at least one contact-less position measuring device (17) is arranged for determining the position of the assembly frame (22) relative to each rail (4).

8. The measuring device (13) according to claim 1, wherein each wheel axle (16) is designed as a telescopic axle (18, 19) on which the measuring wheels (20) having cylindrical running surfaces are arranged.

9. The measuring device (13) according to claim 8, wherein a measuring sensor (35) for registering a track gauge is associated with at least one telescopic axle (18, 19).

10. The measuring device (13) according to claim 8, wherein a guide blade (36) for guidance along a check rail is associated with each measuring wheel (20).

11. The measuring device (13) according to claim 1, wherein at least one measuring wheel (20) is designed as an element of a path measuring device (42).

12. The measuring device (13) according to claim 1, wherein each measuring wheel (20) comprises a running wheel (38) and a flange (39) which are mounted for rotation relative to one another on a shaft (40).

13. The method for recording a track geometry of a track (5) by means of the measuring device (13) according to claim 1, wherein, immediately after an rail undercarriage (3) of the track tamping machine (1) has travelled on the track (5), the wheel axles (16) of the measuring device (13) are pressed onto the rails (4) from above for check measurement of the track geometry, and that the position of the assembly frame (22) is registered by the inertial measuring unit (14).

14. The method according to claim 13, wherein a separate spatial curve is established for each rail (4) in an evaluation device (52) from a spatial curve recorded by means of the inertial measuring unit (14) and from a recorded track gauge.

15. The method according to claim 13, wherein a chord tensioning device (43), arranged on the measuring device (13) and laterally guided between two stops (49, 50), is pressed against one of the two stops (49, 50) for positioning relative to a rail (4).

* * * * *